United States Patent [19]

Shindo et al.

[11] 4,193,427

[45] Mar. 18, 1980

[54] SELVAGE FORMING SYSTEM OF SHUTTLELESS LOOM

[75] Inventors: Akio Shindo, Fuchu; Shinji Mizunaga, Tokyo, both of Japan

[73] Assignee: Nissan Motor Company, Limited, Japan

[21] Appl. No.: 926,238

[22] Filed: Jul. 20, 1978

[51] Int. Cl.[2] ..... D03D 47/40

[52] U.S. Cl. ..... 139/54

[58] Field of Search ..... 139/54, 430, 384 R, 139/383

[56] References Cited

U.S. PATENT DOCUMENTS

| | | | |
|---|---|---|---|
| 2,399,880 | 5/1946 | Moessinger | 139/54 |
| 2,710,631 | 6/1955 | Flamand | 139/54 |
| 3,320,978 | 5/1971 | Kobayashi | 139/54 |
| 3,613,741 | 10/1971 | Ravella | 139/54 |
| 3,880,199 | 4/1975 | Riha et al. | 139/54 |

FOREIGN PATENT DOCUMENTS

| | | | |
|---|---|---|---|
| 2655852 | 10/1977 | Fed. Rep. of Germany | 139/54 |
| 18987 | of 1901 | United Kingdom | 139/54 |

*Primary Examiner*—Henry Jaudon

*Attorney, Agent, or Firm*—Robert E. Burns; Emmanuel J. Lobato; Bruce L. Adams

[57] ABSTRACT

A selvage forming system of a shuttleless loom, comprising two binding devices for respectively binding both sides of a fabric to form selvage structures, the two binding devices being located to cause all of the binding yarns to twist in the same direction during weaving operation, thereby preventing either one of selvage structures from being easily broken.

8 Claims, 4 Drawing Figures

SELVAGE FORMING SYSTEM OF SHUTTLELESS LOOM

BACKGROUND OF THE INVENTION

This invention relates to a selvage forming system of a shuttleless loom, more particularly to an improvement in a selvage forming system of the shuttleless loom of the type wherein rigid selvage structures are formed at both sides of a woven fabric by binding cut end portions of weft yarns with binding yarns.

It is well known that a shuttleless loom is equipped with a selvage forming system which forms selvage structures at the both sides of a fabric during weaving operation of the fabric. The selvage structure is necessary for preventing warp yarns to fray or separate from the both sides of the woven fabric. It is also well known that two binding yarns or threads are twisted together, putting the ends of picked weft yarns between the two binding yarns. In such a selvage forming system, two binding devices, in general, are installed adjacent the both sides of the array of the warp yarns and located opposite to each other. The two binding yarns are drawn from each binding device and guided to the one side of the array of the warp yarns. Then, the two binding yarns continue alternately their opening and closing actions generally at the same time respectively as the opening and closing actions of the array of the warp yarns. Simultaneous, the two binding yarns are twisted together at each pick of the weft yarn to the shed of the warp yarn, to put the ends of the picked weft yarn between the two binding yarns. As will be appreciated from the foregoing, the essential part of each binding device is composed of a rotatable mechanism.

The two binding devices are usually driven to rotate their rotatable mechanisms by a drive shaft for rotatably connecting them. Accordingly, the rotatable mechanisms of the two binding devices are rotated in the same direction with respect to the shuttleless loom. However, the mechanisms are rotated in opposite directions to each other with respect to each binding device itself. Hence, two binding yarns from one binding device are twisted in the direction opposite to that in the two binding yarns from the other binding device.

Now, when a fabric is woven with so-called "spun yarns," it is necessary to use the same spun yarns as the binding yarns for forming the selvage structures of the woven fabric. Because, if so-called "filament yarns" are used as the binding yarns for spun yarn fabric, shrinkages may occur at the selvage structures of the fabric, which are caused by the fact that the shrinking characteristics between the spun yarn and the filament yarn are considerably different.

In case of using a two-ply cotton yarn as each binding yarn, assuming that the weft yarn density is 31 yarns per cm, the two binding yarns are twisted 1550 times per meter of the woven fabric. With respect to the two-ply cotton yarn, about 1000 times twistings per meter are applied to it. Therefore, if the two binding yarns are twisted, during selvage formation, in the direction opposite to that of the twistings previously applied to the two-ply cotton yarn, the twistings previously applied to the two-ply cotton yarn may be almost cancelled. This considerably lowers the strength of the binding yarns for forming one of the two selvage structures of the fabric and therefore the binding yarns of the one selvage structure are liable to cut. Hence, the one selvage structure is also liable to easily break. In order to prevent such a selvage structure breaking, it will be considered to use specially prepared two-ply yarns which are previously twisted in the direction opposite to that in usual two-ply yarns, as the binding yarns for forming the one selvage structure. However, this causes the management of weaving to be troublesome. Furthermore, if such two kinds of binding yarns are used in error, the twistings of all the binding yarns will be cancelled.

SUMMARY OF THE INVENTION

It is the prime object of the present invention to provide an improved selvage forming device of a shuttleless loom, by which rigid selvage structures can be formed at both sides of a woven fabric.

Another object of the present invention is to provide an improved selvage forming device of a shuttleless loom, by which all the binding yarns for forming the selvage structures of a fabric are not liable to be easily cut.

A further object of the present invention is to provide an improved selvage forming device of a shuttleless loom, equipped with two binding devices for binding both ends of weft yarns with bindings yarns to form selvage structures at both sides of a fabric, the two binding devices being located to prevent the windings of all the binding yarns from being cancelled during weaving operation.

A still further object of the present invention is to provide an improved selvage forming device of a shuttleless loom, equipped with two binding devices for binding both ends of weft yarns with binding yarns to form selvage structures of a fabric, the two binding devices being located so that all the binding yarns from the two binding devices are twisting in the same direction during weaving operation.

Other objects, features and advantages of the improved selvage forming system according to the present invention will become more apparent from the following description taken in conjunction with the accompanying drawings in which like reference numerals are assigned to like parts and elements.

DESCRIPTION OF THE PREFERRED EMBODIMENT

Figure 1:
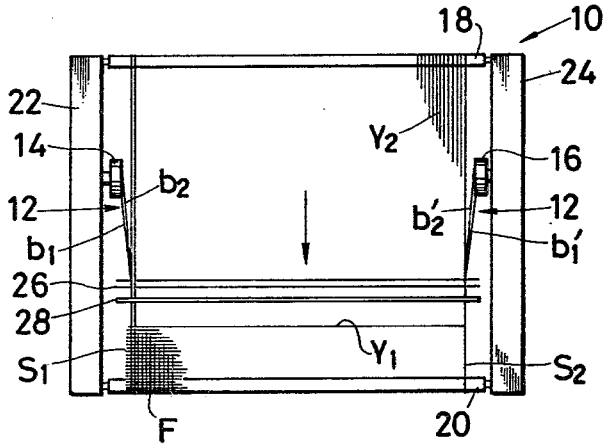
FIG. 1 is a schematic plan view of a shuttleless loom equipped with a selvage forming system in accordance with the present invention.

Referring now to FIG. 1 of the drawings, there is shown an example of a shuttleless loom 10, equipped with a preferred embodiment of a selvage forming system 12 in accordance with the present invention. The selvage forming system 12 is arranged to form first and second rigid selvage structures $S_1$ and $S_2$ at both sides of a fabric F, respectively. In this instance, the selvage forming system 12 comprises first and second binding devices 14 and 16 respectively for binding the cut end portions of weft yarns constituting the first selvage structure $S_1$ and the other cut end portions of the same constituting the second selvage structure $S_2$. Each binding device is arranged to bind the corresponding end portions of weft yarns $Y_1$ with two binding yarns $b_1$ and $b_2$, or $b_1'$ and $b_2'$. The first and second binding devices 14 and 16 have substantially the same construction and are located symmetrically opposite to each other with respect to an array of warp yarns $Y_2$ which are passed on and stretched between rollers 18 and 20, moving in the direction indicated by an arrow. The rollers 18 and 20 are rotatably supported by side frame members 22 and 24, respectively. The reference numerals 26 and 28 denote a heald and a reed, respectively.

Figure 2:
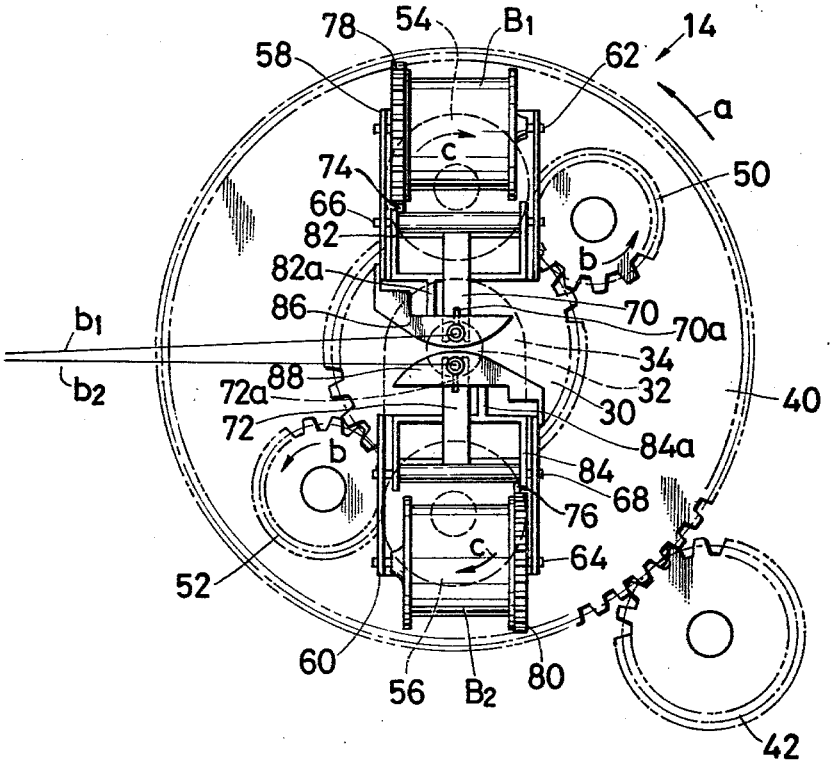
FIG. 2 is a schematic front view of a binding device forming part of the selvage forming system of FIG. 1.
Figure 3:
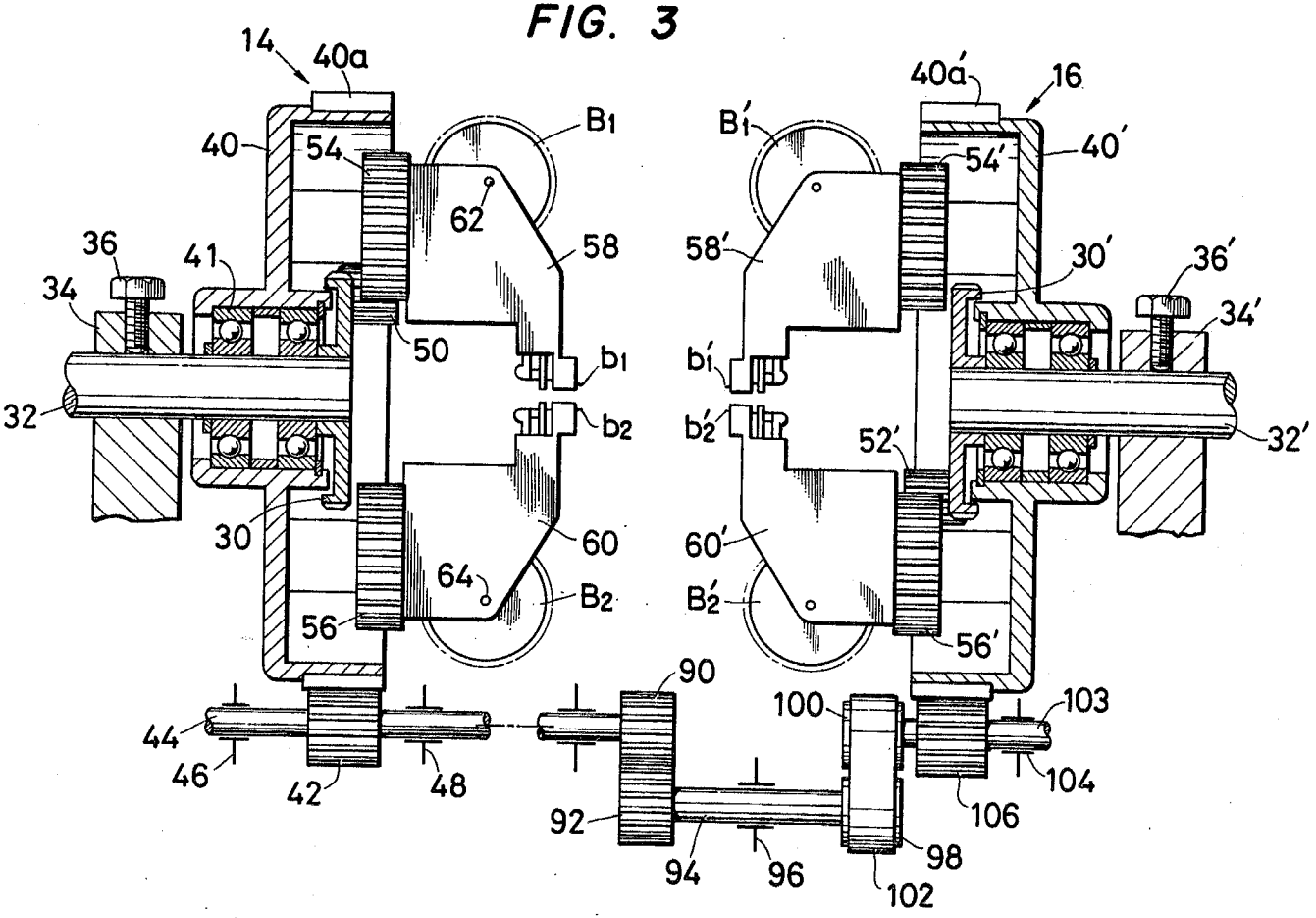
FIG. 3 is a sectional side elevation of the selvage forming device of FIG. 1.

As shown in FIGS. 2 and 3, the first binding device 14 is composed of a sun gear 30 which is fixed on a shaft 32. The shaft 32 is fixed to a bracket 34 secured with a screw 36 to the body (no numeral) of the shuttleless loom 10. A cylindrical carrier 40 is rotatably mounted on the shaft 32 through a bearing 41. The carrier 40 is formed at its peripheral surface with a ring gear portion 40*a* which is meshed with a gear 42. The gear 42 is secured on a drive shaft 44 which is rotatably supported by bearings 46 and 48 and operatively connected to a driving source (not shown). The carrier 40 is, in this instance, rotated by one-half turn at each pick of the weft yarn.

Two planet gears 50 and 52 are rotatably carried or mounted on the carrier 40 and located symmetrically opposite to each other with respect to the shaft 32 of the sun gear 30. The planet gears 50 and 52 mesh with the sun gear 30 as shown. Two auxiliary planet gears 54 and 56 also rotatably carried or mounted on the carrier 40. The auxiliary planet gears 54 and 56 mesh with the planet gears 50 and 52, respectively, but do not mesh with the sun gear 30. In this case, the gear ratio between the sun gear 30 and each auxiliary gear 54 or 56 is 2:1. It is to be noted that the auxiliary planet gears 54 and 56 rotate themselves in the direction opposite to that of their revolutions.

Two bobbin holders 58 and 60 are fixedly mounted on the auxiliary planet gears 54 and 56, respectively. Two bobbins $B_1$ and $B_2$ are rotatably mounted respectively on two shafts 62 and 64 which are supported by the bobbin holders 58 and 60, respectively. Accordingly, the bobbins $B_1$ and $B_2$ rotate integrally with the auxiliary planet gears 54 and 56. The binding yarns $b_1$ and $b_2$ are wound on the bobbins $B_1$ and $B_2$, respectively. The bobbin holders 58 and 60 are equipped respectively with binding yarn control devices (no numerals) for providing tension to the binding yarns $b_1$ and $b_2$ from this first binding device 14. The binding yarn control devices comprise rotatable shafts 66 and 68 which are rotatably supported by the bobbin holders 58 and 60, respectively. Bobbin stop levers 70 and 72 are secured to the shafts 66 and 68, respectively, and provided with Y-shaped cut-out portions 70*a* and 72*a*, respectively. The reference numerals 74 and 76 represent pawls meshed with ratchet wheels 78 and 80, which are secured to the shafts 66 and 68, respectively. Release levers 82 and 84 are rotatably mounted on the shafts 66 and 68, respectively. The release levers 82 and 84 are biased in the counterclockwise direction by springs (not shown) and provided with release bars 82*a* and 84*a* (only their parts shown), respectively.

The binding yarns $b_1$ and $b_2$ wound on the bobbins $B_1$ and $B_2$ are firstly passed through Y-shaped cut-out portions 70*a* and 72*a* and secondly passed on tbe release bars 82*a* and 84*a*, and lastly passed through guide openings (no numerals) formed through guide members 86 and 88 fixed to the bobbin holders 58 and 60, respectively. Such binding yarn control devices are known and their operations have been omitted for the purpose of simplicity of explanation. Meanwhile, the binding yarns $b_1$ and $b_2$ from the guide openings of the guide members 86 and 88 are guided as shown in FIG. 2 to form the selvage structures $S_1$ and $S_2$ at the both sides of the fabric F.

With this first binding device 14, when the carrier 40 is rotated in the direction of an arrow a in FIG. 2 with rotation of the gear 42, the planet gears 50 and 52 are rotated in the direction of arrows b and therefore the auxiliary planet gears 54 and 56 are rotated in the direction of dotted arrows c. As the auxiliary planet gears 54 and 56 rotate, the guide openings of the guide members 86 and 88 rotate around the axis of the sun gear 30. Consequently, the binding yarns $b_1$ and $b_2$ alternately continue the opening and closing (crossing) actions thereof, being twisted in the same direction. Therefore, when the crossed binding yarns $b_1$ and $b_2$ open or separate from each other, the weft yarn $Y_1$ picked into the shed of the warp yarns $Y_2$ is inserted between the binding yarns $b_1$ and $b_2$. Then, the binding yarns $b_1$ and $b_2$ cross to securely bind the one cut end portion of the picked weft yarn $Y_1$. Thereafter, the binding yarns $b_1$ and $b_2$ are opened to await the next picking of the weft yarn $Y_1$. It will be understood that the one of the weft yarn $Y_1$ is securely inserted between the binding yarns $b_1$ and $b_2$ lying between a crossing and the next crossing.

As previously stated, the second binding device 16 is constructed substantially the same as the first binding device 14 and accordingly it operates substantially the same as the first binding device 14 so as to bind the other cut end portion of the picked weft yarn $Y_1$. In this regard, like reference numerals with the addition of a prime are assigned to the corresponding parts and elements. Moreover, the second binding device 16 is located by one side of the array of the warp yarns $Y_2$ and generally symmetrically opposite to the first binding device 14 which is located by the other side of the array of the warp yarns $Y_2$.

Hence, as clearly seen from FIG. 3, the bobbin holders 58 and 60 face the bobbin holders 58' and 60'. It is to be noted that the shaft 44 is provided at its one end with a gear 90 which meshes with a gear 92. The gear 92 is secured to an end of a rotatable shaft 94 which is rotatably supported by a bearing 96 and provided at the other end thereof with a toothed pulley 98. The toothed pulley 98 is drivingly connected to another toothed pulley 100 with a toothed belt 102. The toothed pulley 100 is secured to a rotatable shaft 103 rotatably supported by a bearing 104 and is provided with a gear 106 which is meshed with the ring gear portion 40*a'* of the cylindrical carrier 40' of the second binding device 16. In this instance, the gear ratio between the gears 42 and 106 are 1:1. The gear ratio between the gears 90 and 92 is the same as that between the toothed gears 100 and 98.

In operation of the above-mentioned selvage forming system including the first and second binding devices 14 and 16, when the drive shaft 44 is rotated, the gears 42 and 106 rotate in the opposite directions to each other to rotate the cylindrical carriers 40 and 40' in the opposite directions to each other, respectively. Accordingly, the bobbin holders 58 and 60 of the first binding device 14 are rotated in the direction opposite to the rotating direction of the bobbin holders 58' and 60' of the second device 16. Furthermore, since the first and second binding devices 14 and 16 are located generally symmetrically opposite to each other, the binding yarns $b_1$ and $b_2$ drawn from the guide openings of the guide members 86 and 88 are twisted in the same direction as in the binding yarns $b_1'$ and $b_2'$ drawn from the guide openings of the guide members 86' and 88'. Of course, all the binding yarns themselves are twisted in the same direction. It will be appreciated from the foregoing, that each binding yarn is prevented from its tensile strength lowering caused by cancellation of the previously applied twistings, when the binding yarns used are preveously twisted in the same direction as that of twistings applied to the binding yarns during formation of the selvage structures $S_1$ and $S_2$ of the fabric F. Therefore, the binding yarns are prevented from being damaged and cut and accordingly rigid selvage structures can be formed at the both sides of a woven fabric. In this connection, it is preferable to use, as the binding yarns $b_1$, $b_2$, $b_1'$ and $b_2'$, two-ply yarns which are formed by preveously twisted in the same direction as that of the twistings applied to the binding yarns during the forming the selvage structures $S_1$ and $S_2$.

While the first and second binding devices 14 and 16 have been shown and described to be symmetrically opposite to each other, it will be understood that they may be located so as to be directed in the same direction, in which event the cylindrical carriers 40 and 40' may be rotated in the same direction. In such a case, since the guide openings of the guide members of one binding device 14 or 16 are far from the array of warp yarns $Y_2$, it may be required to install a further binding yarn guiding means (not shown) for guiding the two binding yarns drawn from the above-mentioned guide openings to the corresponding side of the array of warp yarns $Y_2$.

Figure 4:
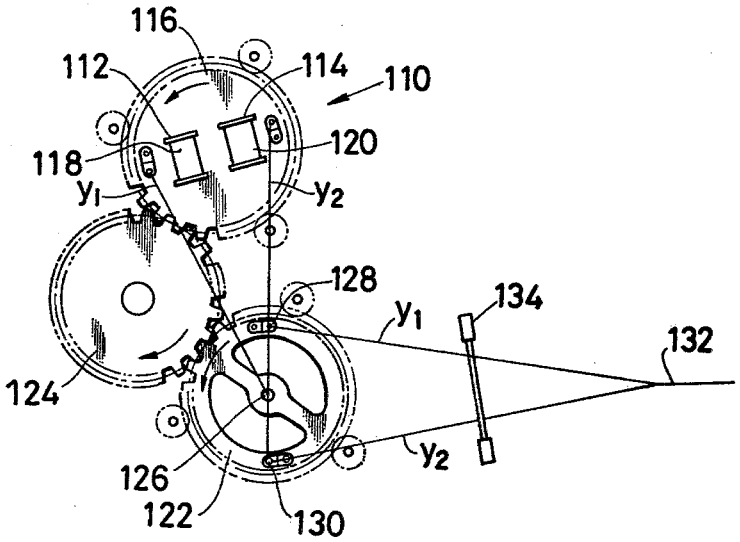
FIG. 4 is a schematic side view of another selvage forming system also to which the principle of the present invention is applicable.

FIG. 4 illustrates another type of binding device 110 forming part of a selvage forming device (no numeral) also to which the principle of the present invention is applicable. Such a type of the binding device is known per se and comprises first and second bobbins 112 and 114 on which first and second binding yarns $y_1$ and $y_2$ are wound, respectively. The first and second bobbins 112 and 114 are rotatably carried on a first rotatable disc 116 which is formed at its peripheral surface with a ring gear portion (no numeral). The rotatable disc 116 is formed with first and second guide openings 118 and 120 through which first and second binding yarns $y_1$ and $y_2$ are guided toward a second rotatable disc 122. The first and second guide openings 118 and 120 are located so as to be diametrically opposed.

As clearly viwed in FIG. 4, the first and second rotatable discs 116 and 122 are meshed at their ring gear portions (no numerals) with the ring gear portion (no numeral) of a counter gear 124. Moreover, the first and second rotatable discs 116 and 122 lie in a plane which is substantially perpendicular to the array of weft yarns (not shown). The second rotatable disc 122 is formed at its central portion with a central guide opening 126 through which the first and second binding yarns $y_1$ and $y_2$ from the first rotatable disc 116 pass. The first and second binding yarns $Y_1$ and $Y_2$ from the central guide opening 126 are respectively guided to first and second peripheral guide openings 128 and 130 through which the first and second binding yarns $y_1$ and $y_2$ are guided to one side of a woven fabric 132. The first and second peripheral guide openings 128 and 130 are located to be diametrically opposed.

With the thus arranged binding device 110, as the first rotatable disc 116 rotates so that its first guide opening 118 approaches to, and the second guide opening 120 separates from, the central guide opening 126 of the second rotatable disc 122, the second rotatable disc 122 rotates so that its first peripheral guide opening 128 separates from and the second peripheral guide opening 130 approaches to the woven fabric 132. In this state, the first and second binding yarns $y_1$ and $y_2$ between the second rotatable disc 122 and the woven fabric 132 are close to each other to cross each other. Therefore, with rotations of the first and second rotatable discs 116 and 122, the first and second binding yarns $y_1$ and $y_2$ between the second rotatable disc 122 and the woven fabric 132 separate from each other as the state shown in FIG. 4. It will be understood that the weft yarn is picked between the first and second binding yarns $Y_1$ and $Y_2$ adjacent the woven fabric 132 and therefore the end of the picked weft yarn is secured or bound between the first and second binding yarns $y_1$ and $y_2$.

While only one binding device 110 has been shown and described to form a selvage structure at one side of the fabric, it will be understood that another binding device (no shown) may be used to form another selvage structure at the other side of the fabric, in which the two binding devices are located so that all binding yarns from the two binding devices are twisted in the same direction.

What is claimed is:

1. A selvage forming system of a shuttleless loom, forming first and second rigid selvage structures at both sides of a fabric, respectively, comprising:

first binding means for binding the first end portions of weft yarns constituting the first selvage structure of the fabric by twisting a first pair of binding yarns having inherent twist, putting the first end portion of each weft yarn between the two binding yarns;

second binding means for binding the second end portions of the weft yarns constituting the second selvage structure of the fabric by twisting a second pair of binding yarns having inherent twist in the same direction as said first pair, putting the second end portion of each weft yarn between the two binding yarns, said second binding means having the same construction as the first binding means and being located symmetrically opposite to said first binding means;

driving means for driving said first and second binding means so that the two binding yarns from the first binding means and the two binding yarns from said second binding means are twisted in the same direction so as to increase the inherent twist of each binding yarn.

2. A selvage forming system of a shuttleless loom, for forming first and second rigid selvage structures at both sides of a fabric, respectively, comprising:

first binding means for binding the first end portions of weft yarns constituting the first selvage structure of the fabric, including first rotatable means for twisting first and second binding yarns having inherent twist, putting the first end portion of each weft yarn between first and second binding yarns, when said first rotatable means is rotated;

a second binding means for binding the second end portions of the weft yarns constituting the second selvage of the fabric, including second rotatable means for twisting third and fourth binding yarns having inherent twist in the same direction as said first and second binding yarns, putting the second end portion of each weft yarn between the third and fourth binding yarns when said second rotatable means is rotated, said second binding means having substantially the same construction as said first binding means and located so that said second rotatable means is symmetrically opposite to said first rotatable means of said first binding means; and driving means for rotatably driving said first and second rotatable means so that said first and second rotatable means are rotated in opposite directions to each other to twist all the binding yarns in the same direction so as to increase the inherent twist of each binding yarn.

3. A selvage forming system as claimed in claim 2, in which said first and second rotatable means are so located that the axis of rotation of said first rotatable means is aligned with the axis of rotation of said second rotatable means.

4. A selvage forming system as claimed in claim 3, in which said first rotatable means includes a first circular carrier rotatably supported on a fixed shaft, first and second planet gears rotatably carried on said first circular carrier and meshed with a sun gear fixedly mounted on the fixed shaft, said first and second planet gears being located symmetrically opposite to each other with respect to the axis of the sun gear, first and second auxiliary planet gears rotatably carried on said first circular carrier and meshed with said first and second planet gears, respectively, first and second bobbin holders fixedly mounted on said first and second auxiliary planet gears, respectively, and having first and second guide members, respectively, for guiding the first and second binding yarns, respectively, and first and second bobbins rotatably supported by said first and second bobbin holders, respectively, the first and second binding yarns being wound on said first and second bobbins, respectively, and supplied through first and second guide members, respectively, to form the first selvage structure; and said second rotatable means includes a second circular carrier rotatably supported on a fixed shaft, third and fourth planet gears rotatably carried on said second circular carrier and meshed with a sun gear fixedly mounted on the fixed shaft, said third and forth planet gears being located symmetrically opposite to each other with respect to the axis of the sun gear, third and fourth auxiliary planet gears rotatably carried on said second circular carrier and meshed with said third and fourth planet gears, respectively, third and fourth bobbin holders rotatably mounted on said third and fourth auxiliary planet gears, respectively, and having third and fourth guide members, respectively, for guiding the third and fourth binding yarns, respectively, and third and fourth bobbins fixedly supported by said third and fourth auxiliary planet gears, respectively, the third and fourth binding yarns being wound on said third and fourth bobbins, respectively, and supplied through the third and fourth guide members, respectively, to form the second selvage structure.

5. A selvage forming system as claimed in claim 4, in which said driving means includes rotating means for rotating said first and second circular carriers in the opposite directions to each other at the same rotational speed.

6. A selvage forming system as claimed in claim 5, in which said first and second circular carriers are formed at their peripheral surfaces with first and second ring gear portions, respectively.

7. A selvage forming system as claimed in claim 6, in which said rotating means includes a first gear meshed with said first ring gear portion of said first circular carrier, a second gear meshed with said second ring gear portion of said second circular carrier, and connecting means for mechanically connecting said first gear to said second gear so that said first and second gears rotate in the opposite directions to each other.

8. A selvage forming system as claimed in claim 7, in which said connecting means includes a third gear fixedly connected to said first gear, a fourth gear meshed with said third gear, a first toothed pulley securely connected to said fourth gear, a second toothed pulley secured to said second gear, and a toothed belt meshed with and passed on said first and second toothed pulleys to rotate said second toothed pulley with rotation of said first toothed pulley.

* * * * *